US008051866B2

(12) United States Patent
Cutler

(10) Patent No.: US 8,051,866 B2
(45) Date of Patent: Nov. 8, 2011

(54) COVERING SYSTEM

(76) Inventor: Daniel Cutler, Geneva (CH)

( * ) Notice: Subject to any disclaimer, the term of this patent is extended or adjusted under 35 U.S.C. 154(b) by 676 days.

(21) Appl. No.: 11/721,354

(22) PCT Filed: Dec. 21, 2005

(86) PCT No.: PCT/GB2005/004973
§ 371 (c)(1),
(2), (4) Date: Aug. 13, 2007

(87) PCT Pub. No.: WO2006/067440
PCT Pub. Date: Jun. 29, 2006

(65) Prior Publication Data

US 2009/0139663 A1 Jun. 4, 2009

(30) Foreign Application Priority Data

Dec. 21, 2004 (GB) ..... 0427994.9
Sep. 26, 2005 (GB) ..... 0519596.1

(51) Int. Cl.
*E04H 15/58* (2006.01)
*E04F 10/06* (2006.01)

(52) U.S. Cl. ..... 135/117; 135/88.12; 135/119; 135/120.4; 160/45; 160/66; 52/74

(58) Field of Classification Search ..... 135/88.1, 135/88.11, 88.12, 123, 115, 117, 119, 120.4, 135/903; 160/46, 66–69, 75, 262; 296/20, 296/36, 163; 52/74–75, 83, 222
See application file for complete search history.

(56) References Cited

U.S. PATENT DOCUMENTS 3,594 A * 5/1844 Sebo ..... 160/46
166,618 A * 8/1875 Lussenhop ..... 160/46
(Continued)

FOREIGN PATENT DOCUMENTS

CH 503884 8/1969
(Continued)

*Primary Examiner* — Winnie Yip
(74) *Attorney, Agent, or Firm* — Sutherland Asbill & Brennan LLP

(57) ABSTRACT

The present application relates to a covering apparatus for covering an outdoor area comprising a screen (1) that can be operated between a retracted and an extended configuration, the screen having a leading portion (2) and a trailing portion (4), the trailing portion (4) being connected to a first support (5, 6), the apparatus further comprising a plurality of longitudinal flexible elements (11, 12) extending from the first support (5, 6) to respective second supports (9, 10), and the leading portion (2) of the screen (1) being supported by the longitudinal flexible elements (11, 12) as the screen (1) is operated from the retracted to the extended configuration, wherein the leading portion (2) of the screen (1) is moveably mounted to the longitudinal flexible elements (11, 12) such that the leading portion (2) moves with respect to the longitudinal flexible elements (11, 12) during operation between retracted and extended positions, and wherein at least one clamping system is provided on the leading portion (2) of the screen (1) for releasably clamping the leading portion (2) to at least one of the longitudinal flexible elements (11, 12).

31 Claims, 14 Drawing Sheets

U.S. PATENT DOCUMENTS

| | | | | | |
|---|---|---|---|---|---|
| 262,398 | A | | 8/1882 | Gerard | |
| 1,106,624 | A | | 8/1914 | Cadwallader | |
| 3,510,996 | A | * | 5/1970 | Popil | 52/64 |
| 4,032,186 | A | | 6/1977 | Pickering et al. | |
| 4,068,404 | A | * | 1/1978 | Sheldon | 47/22.1 |
| 4,175,576 | A | * | 11/1979 | Iby | 135/88.1 |
| 4,565,230 | A | | 1/1986 | Van Rijn et al. | |
| 4,754,774 | A | * | 7/1988 | Leader | 135/88.14 |
| 5,170,811 | A | * | 12/1992 | Kirk et al. | 135/88.11 |
| 5,259,432 | A | * | 11/1993 | Danieli | 160/66 |
| 5,265,373 | A | | 11/1993 | Vollebregt | |
| 5,365,989 | A | | 11/1994 | Eger et al. | |
| 5,441,068 | A | | 8/1995 | Rasch et al. | |
| 5,655,585 | A | | 8/1997 | Fry | |
| 5,682,937 | A | | 11/1997 | Decrane et al. | |
| 5,794,679 | A | | 8/1998 | Williams | |
| 5,924,465 | A | | 7/1999 | Malott | |
| 5,927,363 | A | | 7/1999 | Olsen | |
| 5,960,806 | A | | 10/1999 | Steiner | |
| 6,012,505 | A | | 1/2000 | Wurz et al. | |
| 6,021,836 | A | | 2/2000 | Schmitz | |
| 6,050,280 | A | | 4/2000 | Jeske | |
| 6,112,392 | A | | 9/2000 | Becker et al. | |
| 6,125,905 | A | | 10/2000 | Woodside et al. | |
| 6,142,554 | A | | 11/2000 | Carroll et al. | |
| 6,152,516 | A | | 11/2000 | Williams | |
| 6,202,660 | B1 | | 3/2001 | Steiner | |
| 6,247,484 | B1 | * | 6/2001 | Thomas | 135/123 |
| 6,260,908 | B1 | | 7/2001 | Fraula et al. | |
| 6,273,115 | B1 | | 8/2001 | Guggisberg | |
| 6,273,172 | B1 | | 8/2001 | Frey | |
| 6,276,381 | B1 | | 8/2001 | O'Brien | |
| 6,341,638 | B1 | | 1/2002 | Thompson et al. | |
| 6,363,664 | B1 | | 4/2002 | Brutsaert | |
| 6,412,536 | B1 | | 7/2002 | Vannetta | |
| 6,484,785 | B2 | | 11/2002 | Dieckmann | |
| 6,488,069 | B1 | | 12/2002 | Mashaw et al. | |
| 6,494,246 | B1 | | 12/2002 | Blevins | |
| 6,557,512 | B2 | | 5/2003 | Leipelt et al. | |
| 6,662,815 | B2 | | 12/2003 | Tung | |
| 7,178,536 | B2 | * | 2/2007 | Holtkamp | 135/88.13 |
| 2004/0055633 | A1 | | 3/2004 | Lambey | |

FOREIGN PATENT DOCUMENTS

| | | | | |
|---|---|---|---|---|
| CH | 455245 | | | 10/1996 |
| DE | 1430977 | A1 | | 11/1968 |
| DE | 2525600 | | | 11/1976 |
| DE | 2817210 | | | 4/1978 |
| DE | 2817210 | A1 | | 11/1978 |
| DE | 3130858 | | | 5/1983 |
| DE | 3443860 | A1 | | 6/1985 |
| DE | 3540758 | | | 4/1987 |
| DE | 3721738 | | | 1/1988 |
| DE | 9209608 | | | 7/1992 |
| DE | 4406905 | A1 | | 9/1994 |
| DE | 4407342 | | | 11/1994 |
| DE | 29519259 | | | 12/1995 |
| DE | 19833031 | C1 | | 7/1998 |
| DE | 20113085 | | | 8/2001 |
| DE | 20309971 | | | 9/2003 |
| DE | 20309971 | U1 | | 9/2003 |
| DE | 202004000975 | U1 | | 4/2004 |
| DE | 3730696 | | | 6/2009 |
| EP | 0430882 | | | 6/1991 |
| EP | 0567030 | | | 10/1993 |
| EP | 920800 | A1 | * | 6/1999 |
| EP | 1113120 | A1 | | 7/2001 |
| EP | 1452684 | | | 1/2004 |
| EP | 0676514 | | | 6/2009 |
| FR | 1187516 | | | 9/1959 |
| FR | 1488224 | | | 7/1967 |
| FR | 2246702 | | | 10/1973 |
| FR | 2559527 | A1 | | 2/1984 |
| FR | 2668788 | | | 5/1992 |
| FR | 2756314 | | | 5/1998 |
| FR | 2840331 | | | 12/2003 |
| FR | 2697720 | | | 8/2007 |
| GB | 622856 | | | 5/1949 |
| GB | 1501615 | | | 7/1978 |
| GB | 2334063 | | | 8/1999 |
| JP | 07305469 | | | 11/1995 |
| JP | 2006169835 | A | * | 6/2006 |
| JP | 04155087 | | | 6/2009 |
| NL | 1016241 | | | 8/2007 |
| WO | 2006/033959 | | | 3/2006 |
| WO | 2004/011760 | A1 | | 8/2007 |

* cited by examiner

COVERING SYSTEM

TECHNICAL FIELD

The present invention concerns a covering system. More specifically, the present invention relates to a system such as a canopy or an awning for providing sun protection, rain protection or the like.

BACKGROUND OF THE INVENTION

There is a general need to provide covering over open areas to provide protection from the rain and/or shade from the sun, so that people can enjoy the open air without being inconvenienced by the weather. It is commonplace to use retractable covers, for example, to cover small seating areas outside restaurants, private gardens and patios. However, covering larger areas of these examples and others such as children's play areas or campgrounds, outdoor swimming pools, amphitheaters and stadiums, with a retractable cover requires an entirely different system to those in existence. It is particularly desirable that such a covering system can be easily and quickly erected and dismantled to suit the particular weather conditions, thus causing minimum disruption to the users. It is also desirable for a single covering system to be able to cover a large area, so that it is not necessary to use a number of smaller systems in combination (which may not only be less visually attractive but also less effective and more inconvenient to assemble).

Another situation that requires the use of large covered areas is agriculture. Some plantations, fields or vineyards are covered by nets, plastic sheeting etc. to provide protection and preferential cultivation conditions for the crops.

A number of covering systems are known in the art. Some systems are free-standing and others require attachment to a building or a vehicle. U.S. Pat. No. 5,441,068 discloses a sunshade having a column that can be anchored to the ground. A number of arms spaced around the column support a sunshade membrane in the open position, and can be folded down adjacent the column to remove the shade as desired. U.S. Pat. No. 5,960,806 also discloses a free-standing sunshade. However, a disadvantage with umbrella-like sunshades is that these systems need a strong and thus often bulky and unattractive base, that usually has to feature at or near the centre of the covered area. Furthermore, these shades tend to be relatively small and thus many may be required to cover a large area.

Another type of covering system utilises a rolled cover that may be extended over the desired area.

U.S. Pat. No. 5,924,465 is an example of such an awning system for a vehicle. It comprises an awning rolled on a tube, arms extending from the side of the vehicle to support each side of the awning, a bracket connected between a side arm and the base of the vehicle to support the side arm, and a post resting on the ground to support a side arm. The awning can be unrolled and the various support members put in place, and then retracted and dismantled as necessary.

U.S. Pat. No. 6,494,246 also describes a retractable awning, that may be attached to a vehicle or building. The awning is unrolled from a roller tube. One end is fixed to a structure (vehicle or building) and the far end connected to the roller tube is supported by brackets extending at an angle between the roller tube and a lower point on the structure. A number of further retractable supports are provided underneath the awning to support the awning and are attached at one end to the structure.

U.S. Pat. No. 6,557,612 discloses a particular kind of articulated arm for supporting an awning, that can be extended and folded as the awning is extended and retracted.

Such systems that use a variety of arms, brackets and posts to support a cover have a number of disadvantages. Firstly, they can be bulky and heavy so that they can only be of a limited size and cover a relatively small area. This also means that they can be difficult and time consuming to erect and remove, which is obviously undesirable as a change in weather condition needs to be accommodated quickly. The supporting arms and brackets can be unattractive, but are required in known systems to support the cover and prevent it sagging, being particularly important with large covers.

Another system is known from French publication FR 2 559 527. The disclosed mechanism is designed for rolling up, unrolling and stretching an awning canopy over a horizontal or slightly sloping plane. The mechanism combines the rolling up, unrolling, traction and tension of a multi-purpose awning canopy. The rotation of a rolling-up tube unrolls the canopy and simultaneously rolls up (but in the opposite direction) a set of cables which, guided by two lateral pulleys and two return pulleys, pull a loading bar in which one or more traction springs are incorporated. These springs deliver a constant and progressive tension to the cables and to the canopy which is thus always stretched. At the end of the tube, a set of "ring pulleys" having a variable diameter, compensate for the various thicknesses of the rolled-up tube.

It can be seen that this system does not use large and heavy arms and brackets to support the cover, instead holding it taut and horizontal using two cables and providing tension with a spring. The cables must be thin enough to wrap round the small diameter of the ring pulleys. This system is not suitable for the heavy load of a large cover, not least because it relies on holding the cover in tension by the thin cables. Tension in the cover is also limited by the extent the spring can be stretched. Furthermore, the apparatus is limited by the tensile strength of the cover. Thus this system is clearly suitable only for small and light-weight covers with adequate tensile strength and is far from ideal for supporting large covers that require strong support and means to prevent sagging.

WO 2004/011760 describes a rolling blind in which two fabrics are wound conjointly on a keyway tube which travels along guide rails or wires, winding or unwinding both fabrics at once. The system provides tension in the fabrics by means of springs. This is one reason why it is not suitable for larger applications.

SUMMARY OF THE INVENTION

An aim of the present invention is to provide a system that is able to cover large areas while remaining simple, using relatively few visible components.

According to a first aspect of the invention, there is provided a covering apparatus for covering an outdoor area comprising a screen that can be operated between a retracted and an extended configuration, the screen having a leading portion and a trailing portion, the trailing portion being connected to a first support, the apparatus further comprising a plurality of longitudinal flexible elements extending from the first support to respective second supports, and the leading portion of the screen being supported by the longitudinal flexible elements as the screen is operated from the retracted to the extended configuration, wherein the leading portion of the screen is moveably mounted to the longitudinal flexible elements such that the leading portion moves with respect to the longitudinal flexible elements during operation between retracted and extended positions, and wherein at least one clamping system is provided on the leading portion of the screen for releasably clamping the leading portion to at least one of the longitudinal flexible elements.

The first support will often be the side of a building or vehicle, but it may be free-standing and may comprise a plurality of elements such as poles. It may also be the roof of a building or a stadium.

Preferably, the longitudinal flexible elements are held in tension. The longitudinal flexible elements may be made from strong tensile elements such as a wire or metal (e.g. steel) rope. It can be seen that these elements can directly support the leading portion of the screen, whereas in FR2559527 thin cables merely hold it in tension without providing any direct vertical support. Thus, the present apparatus is not limited by the tensile strength of the screen itself, as in the prior art. Therefore, the screen of the present invention can be made much larger than is possible in the prior art for a given strength of screen material, or alternatively a lower strength screen material can be employed for a given size of screen. Furthermore, the support provided by the present invention prevents sagging of even a large screen, which could not be achieved by the tensile method of FR2559527.

In the preferred embodiments, the length of screen which is not deployed is stored at one end of the apparatus. More preferably it is stored, e.g. rolled up, in a housing which is separate from the longitudinal flexible elements so that the longitudinal flexible elements do not carry any more weight than is necessary.

An advantage of this invention, as described above, is that there is no need for any supporting framework around the screen. The only support structures required are the first support and the second supports. For example, in an arrangement for a rectangular screen, this could be just four anchor points, one for each corner of the screen, i.e. one first support and one second support at opposite ends of two longitudinal flexible elements.

According to another aspect of the invention, there is provided a covering apparatus for covering an outdoor area comprising a screen that can be operated between a retracted and an extended configuration, the screen having a leading portion and a trailing portion, the trailing portion being connected to a first support, the apparatus further comprising a plurality of longitudinal elements extending from the first support to respective second supports, wherein the leading portion of the screen is supported by the longitudinal elements as the screen is operated from the retracted to the extended configuration, wherein the leading portion of the screen is moveably mounted to the longitudinal elements such that the leading portion moves with respect to and is supported by the longitudinal elements during operation between retracted and extended positions, and wherein the longitudinal elements each comprise a wire under tension.

When it is desired to cover a large area and the covering system needs to have a long span, the tension in the wires will need to be increased in order to prevent them from sagging too much. Tension in the wires is only required when the screen is deployed and therefore when the screen is retracted, the tension in the wires may be lessened in order to prolong their life. Therefore, preferably the tension in the longitudinal elements can be varied.

In order to avoid sag of the longitudinal elements over a wide span, it is possible to construct each longitudinal element from a wire threaded through a series of tubes, stretched to provide tension and clamped at both ends. The tubes in such a longitudinal element provide extra rigidity and allow the longitudinal element to span a greater distance with reduced sag. A further advantage of such longitudinal elements is that the tension in the wire is provided by creating compression in the tubes. Therefore tension need not be provided by the first or second supports and there may not be any need for additional guy ropes. Such a system is also not limited to the tension which can be supported by existing structures such as the wall or roof of a building.

Preferably the wire is spaced from the inside of the tubes so that the wire cannot move around laterally within the tubes. Alternatively, the tubes may have an internal diameter just large enough to accommodate the wire. The external diameter of the tubes can be chosen according to the required strength of the longitudinal elements. Preferably the tension in the wire can be adjusted as needed. For example the tension in the wire can be increased when the covering system is to be deployed and reduced once the system is retracted.

A further advantage of longitudinal elements created from a wire through a series of tubes is that the tubes can be provided with a rough surface for providing friction. For example the tubes can be coated with rubber. Alternatively the tubes can be provided with teeth and the screen can be mounted on toothed rollers which engage with the teeth and drive the screen along the longitudinal elements. In this way the screen can also be extended at an angle upwards from the horizontal.

Second supports can be provided in a plurality of directions and a corresponding plurality of screens can be provided to create a multidirectional covering. In one preferred arrangement, two screens may be provided back to back on either side of a free standing first support and extending in opposite directions therefrom.

In one form of the invention the leading portion is arranged to slide relative to the tensile elements. Thus, viewed from another aspect, the present invention provides a covering apparatus comprising a screen that can be operated between a retracted and an extended configuration, the screen having a leading portion and a trailing portion, the trailing portion being connected to a first support, wherein the apparatus further comprises a plurality of longitudinal flexible elements extending from the first support to respective second supports, and wherein the leading portion of the screen is moveably mounted to the longitudinal flexible elements such that the leading portion moves with respect to and is supported by the longitudinal flexible elements during operation between retracted and extended positions, and the leading portion is supported by the longitudinal flexible elements when the screen is deployed in at least a partially extended position.

According to another aspect of the invention, there is provided a covering apparatus comprising a screen that can be operated between a retracted and an extended configuration, the screen having a leading portion and a trailing portion, the trailing portion being connected to a first support, the apparatus further comprising a plurality of longitudinal elements extending from the first support to respective second supports, wherein the leading portion of the screen is supported by the longitudinal elements as the screen is operated from the retracted to the extended configuration.

Preferably, the apparatus further comprises a rigid transverse element fixed to the leading portion of the screen. This prevents the leading edge from sagging and reduces lateral forces on the longitudinal flexible elements.

Some known covering systems provide numerous thin wires along which a lightweight screen can be pulled. These systems typically have the screen suspended from the wires by passing the wires through reinforced holes in the screen fabric or by suspending it from simple loops or hooks. These methods are adequate for small and light weight systems where each wire does not need to carry much weight and is relatively thin. However for larger, heavier screens, supported by fewer wires, a much thicker heavy duty wire or cable is required to support the weight of the screen. With the thicker cable and heavier screen, reinforced holes, hooks or loops provide too much friction and hinder the deployment or retraction of the screen.

Therefore, preferably, the apparatus further comprises a roller unit, which may be in the form of a roller casing, disposed on each longitudinal flexible element, the roller unit (or casing) comprising at least one and more preferably two or more rollers which allow the roller casing to roll along the longitudinal flexible element.

The roller casings may be individually mounted and independently moveable along their respective longitudinal flexible elements. However, preferably the roller casings are attached to the leading portion of the screen via the transverse element, to moveably mount the leading portion of the screen to the longitudinal flexible elements. The roller casings at either end of the transverse element then move along their respective longitudinal flexible elements together.

Providing rollers instead of holes, hooks or loops reduces the friction between the screen and the longitudinal flexible elements. This is important when stronger, larger diameter cables are needed to support larger screens. Further, if the rollers are motorised, the screen can be drawn out along the longitudinal flexible elements. As discussed in more detail below, the roller casings are preferably provided with rollers which sandwich the longitudinal flexible elements between them and are biased so as to grip the longitudinal flexible elements. This further increases the friction between the rollers and the longitudinal flexible elements and allows a longer, heavier screen to be deployed.

The clamping mechanism of the invention may be independent of the rollers. However, in the preferred embodiments the roller casing further comprises said clamping system to clamp the roller casing to the longitudinal flexible element when it is placed in a desired position. Once the clamp is set, retracting the screen to take up the slack provides the tension to keep the screen taut and level. By clamping the leading portion of the screen to the longitudinal flexible elements, a much greater tension can be applied to the screen. The tension is only limited by the power of the retraction mechanism, the strength of the clamp, and the strength of the screen material. Prior art systems have only provided tension via springs, where recoil strength, and hence tension, varies depending on the extent to which the spring is pulled. Since pull on the spring varies depending upon the extent to which the cover is deployed, constant tension cannot be provided at all times and at all deployment lengths. Furthermore, the recoil strength of a spring becomes reduced over time.

If the screen is not provided with sufficient tension when deployed, it will sag and wilt also be more affected by any winds present. Preferably, the tension provided in the screen can be varied according to requirements. The clamping system may comprise a plate which is pushed into a clamping position by a spring.

In an alternative clamping system, the roller casing has two upper rollers which support the roller casing on the longitudinal flexible element and a lower roller located beneath the longitudinal flexible element. The lower roller may be moved between a non-clamping position in which it allows the roller casing to roll smoothly along the longitudinal flexible element, and a clamping position in which the lower roller is biased or urged so that it provides pressure towards the two upper rollers so as to clamp the longitudinal flexible element between the upper and lower rollers. A means for biasing or urging the lower roller may be for example a spring, a screw, a camming device, a pneumatic or a hydraulic arrangement.

In another alternative clamping system, the roller casing has two upper rollers which support the roller casing on the longitudinal flexible element and two oppositely arranged side rollers for clamping the longitudinal flexible element. The side rollers may be biased or urged from a non-clamping position into a clamping position by springs, screws, camming devices, pneumatic or hydraulic arrangements. In a particularly preferred embodiment however, the side rollers are arranged so as to run freely when the roller case is pulled in the direction of extending the screen, but clamp the longitudinal flexible element when the roller case is pulled in the direction of retracting the screen. A release mechanism is preferably also provided which releases the side rollers from their clamped position so that the screen may be retracted.

Such a clamping arrangement may comprise two oppositely arranged side rollers each rotatable around a substantially vertical axle. These axles are each slidably mounted in slots, the slots being closer together at the end nearest the leading edge than they are at the end furthest from the leading edge. In this way, when the screen is extended, the axles of the side rollers move further apart and the rollers run freely, but when the screen is retracted, the axles of the side rollers move closer together thus clamping the longitudinal flexible element between the side rollers.

These clamping systems are believed to be independently inventive and therefore, according to another aspect of the invention, there is provided a clamping arrangement for a roller system comprising at least two first rollers on one side of a longitudinal element and at least one second roller on the other side of a longitudinal element, wherein the second roller may be biased or urged towards the first rollers so as to clamp the longitudinal element between the first and second rollers.

Viewed from an alternative aspect, there is provided a clamping system for a roller casing, comprising two upper rollers which support the roller casing on the longitudinal element and a lower roller located beneath the longitudinal element, the lower roller being movable between a non-clamping position in which it allows the roller casing to roll smoothly along the longitudinal element, and a clamping position in which the lower roller is biased or urged towards the two upper rollers so as to clamp the longitudinal element between the upper and lower rollers. A means for biasing or urging the lower roller may be for example a spring, a screw, a camming device, a pneumatic or a hydraulic arrangement.

According to another aspect of the invention, there is provided a clamping system for a roller casing, comprising two upper rollers which support the roller casing on the longitudinal element and two oppositely arranged side rollers which can be biased or urged from a non-clamping position into a clamping position in which they clamp the longitudinal element. The side rollers may be biased or urged from the non-clamping position into the clamping position by springs, screws, camming devices, pneumatic or hydraulic arrangements. In a particularly preferred embodiment however, the side rollers are arranged so as to run freely when the roller case is pulled in the direction of extending the screen, but clamp the longitudinal flexible element when the roller case is pulled in the direction of retracting the screen. A release mechanism is preferably also provided which releases the side rollers from their clamped position so that the screen may be retracted.

According to another aspect of the invention, there is provided a covering apparatus comprising a screen that can be operated between a retracted and an extended configuration, the screen having a leading portion and a trailing portion, the trailing portion being connected to a first support, the apparatus further comprising a plurality of longitudinal flexible elements extending from the first support to respective second supports, wherein the leading portion of the screen is supported by the longitudinal flexible elements as the screen is operated from the retracted to the extended configuration and wherein the apparatus further comprises a roller unit disposed on each longitudinal flexible element, each roller unit comprising at least two rollers which allow the roller unit to move along the respective longitudinal flexible element and a clamping system to clamp the roller unit to the respective longitudinal flexible element in a desired position.

As is known in the art, cover systems can be activated electrically as well as manually. The system of the invention can also be motorised so that the screen can be extended and retracted electrically. The screen roll as well as the wheels and clamps in the roller cases can all be motorised.

In the system of the present invention, if the roller casings are to be motorised, electricity must somehow be supplied to the roller casings. This can be done by running a power cable down the side of the screen to one of the roller casings. Power can then be supplied to the other roller casing by running a cable along the leading portion of the screen. However with this method, if the screen is rolled up, the cable causes the rolled up screen to be significantly thicker at the side where the cable is mounted. Therefore, preferably the cable is run diagonally through the screen from one side at the trailing portion of the screen to the opposite side at the leading portion of the screen. Thus, when the screen is rolled up, the cable is evenly spread throughout the length of the roll and the thickness of the roll is uniform. This makes for a more efficient storage of the rolled up screen by minimising the maximum diameter of the screen roll. An alternative way of achieving an even diameter of rolled up screen is to run a power cable from each corner by the trailing portion of the screen diagonally towards the centre of the screen and then diagonally from the centre of the screen to the corners by the leading portion of the screen where the roller cases are mounted. The wires may cross over in the centre, each carrying power from a corner of the screen at the trailing portion to the diagonally opposite corner on the leading portion of the screen or they may change direction in the centre, each carrying power from a corner of the screen at the trailing portion to the corner on the same side of the screen at the leading portion. In the latter arrangement, the two power carrying wires are preferably held together to help maintain the X-shape which reduces the overall diameter of the rolled up screen.

At the trailing portion of the screen the wires are connected to an external power supply.

The above method of transferring power through the screen is believed to be independently inventive. Therefore, according to a further aspect of the invention, there is provided a method of transferring electrical power along a screen of a covering apparatus, wherein at least one power transferring cable transfers the power diagonally along the screen from a trailing portion of the screen to a leading portion of the screen.

According to another aspect, the invention provides a method of reinforcing a screen of a covering apparatus by attaching reinforcing members to the screen which run diagonally across the screen from a trailing portion of the screen to a leading portion of the screen.

The reinforcing members may be wires or cables or straps.

Sometimes, when the tension in the screen becomes too high, e.g. in high winds, it becomes necessary to retract the screen so as to prevent it from being damaged. Therefore, in a preferred embodiment, the apparatus may be further provided with an automatic retraction system.

Automatic retraction systems which use wind sensors to determine when to retract the screen are known. However, wind is not the only factor in increasing tension in the screen. Accumulation of water or snow also increases the tension in the screen and would go undetected by a wind sensor.

Therefore, a particularly preferred embodiment of the invention further comprises an automatic retraction system comprising a tension sensor which senses the tension in the screen and retracts the screen when a threshold tension is exceeded. In one embodiment the tension sensor senses the tension in the screen directly. In an alternative embodiment, the tension sensor senses the tension in at least one of the longitudinal flexible elements. The tension sensor may be located in the roller casing or it may be located on one of the supports. If it is located in the roller casing it may be combined with the clamping arrangement by sensing the pressure on the clamping element of the clamping arrangement.

The automatic retraction system described above is believed to be independently inventive and therefore, according to a further aspect of the invention, there is provided an automatic retraction system for a covering apparatus, wherein a tension sensor senses the tension in a screen of the covering apparatus and causes retraction of the screen if the sensed tension exceeds a predetermined threshold value.

As described above, the tension sensor may directly sense the tension in the screen or it may determine the tension in the screen by sensing the tension in a support of the screen. In this latter arrangement, the tension sensor is preferably calibrated each time the screen is deployed or retracted.

A further problem of large covering systems where the screen is rolled up when retracted is that for a long screen, the diameter of the cylinder of retracted screen can be quite large. This has not previously been a problem with covering systems because known covering systems have not been capable of extending as far as the system described above.

However, in order to avoid such a large diameter of retracted screen a preferred embodiment of the covering system of the invention provides a plurality of rollers around which the screen is wrapped when retracted. In one embodiment, two storage rollers are provided which are driven synchronously so as to wind the screen around them in such a way as to provide a generally oval cross-section.

The rollers may be driven by a third driving roller, smaller in diameter than the storage rollers and located between them in driving contact with both rollers.

Alternatively the storage rollers may be synchronously driven by a drive belt or chain.

In another alternative embodiment, three rollers are provided in a triangular arrangement and are driven synchronously so as to retract the screen around the three rollers in such a way as to provide a generally triangular cross-section.

By using a plurality of smaller storage rollers instead of a single storage roller, the covering system may be made more space efficient.

Such a storage system is also believed to be independently inventive. Therefore, according to another further aspect of the invention, there is provided a storage system for a covering apparatus comprising a plurality of rollers around which the sheet is stored and which are arranged so as to determine a cross-sectional shape of the stored sheet.

In this way, rollers can be arranged so as to make the best use of available space and the sheet can be stored with high spatial efficiency.

A flexible base member may be provided around the storage rollers and driven by the storage rollers. The sheet is attached to the flexible base member. Alternatively the sheet may be wound around the storage rollers and attached to itself so as to form a closed loop around the rollers at the trailing end thereof.

The flexible base member or the loop of fabric formed at the trailing end of the sheet have sufficient frictional engagement with the storage rollers that when at least one of the storage rollers is driven, the sheet or the base member is also driven and the sheet is retracted around the storage rollers.

In a preferred embodiment, the friction between the storage rollers and the sheet or base member is increased by providing a spring or springs which bias the storage rollers apart. Friction can also be increased by giving the rollers a rough or sticky surface, e.g. by providing rubber strips on the rollers.

These and other features of the present application will become apparent to one of ordinary skill in the art upon review of the following detailed description when taken in conjunction with the drawing and appended claims.

BRIEF DESCRIPTION OF THE DRAWING

Preferred embodiments of the present invention will now be described by way of example only and with reference to the accompanying drawings, in which.

DETAILED DESCRIPTION OF THE INVENTION

Figure 1:
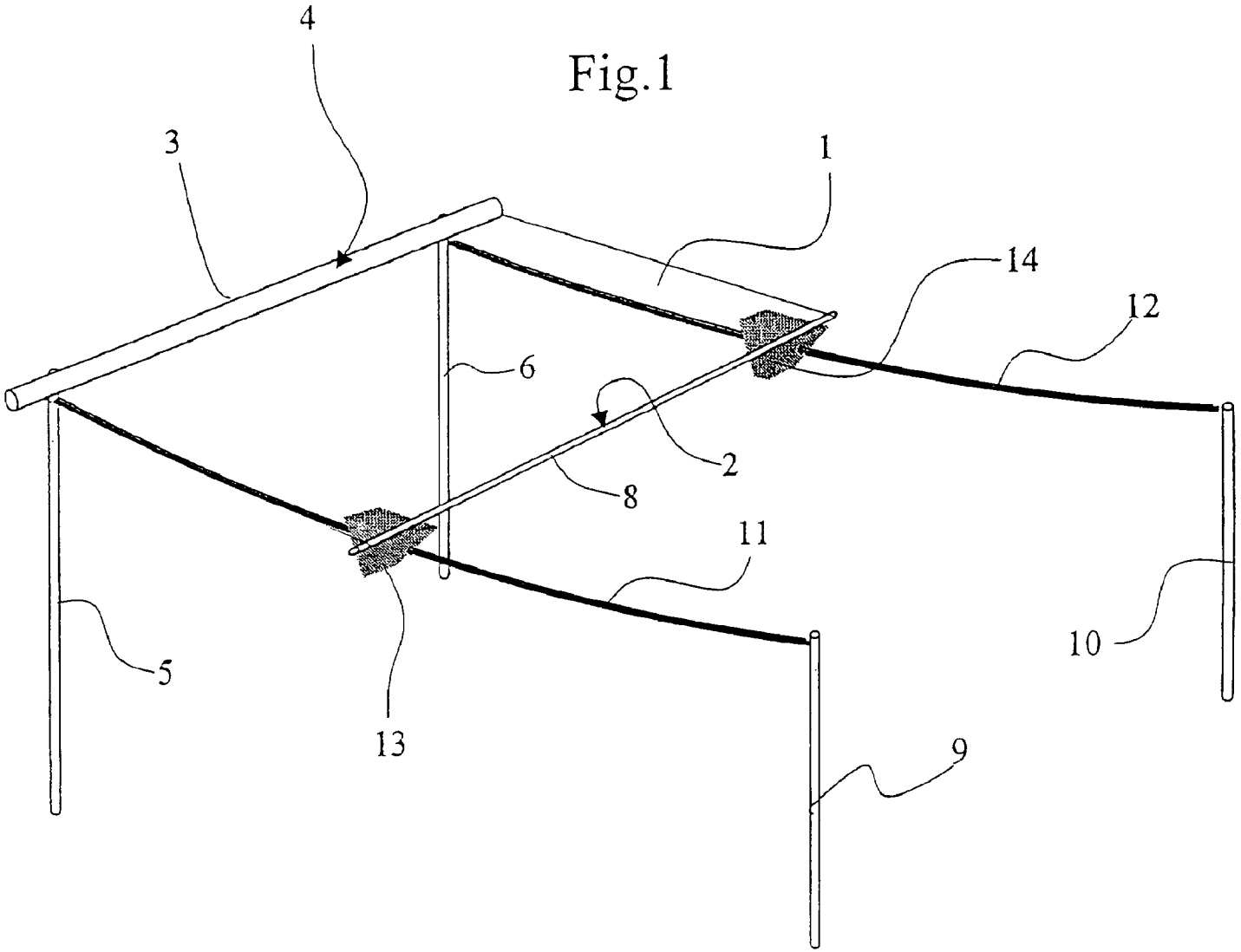
FIG. 1 shows a first embodiment of the covering system according to the invention.

In FIG. 1, a first embodiment of the covering system is represented. The system comprises a sun or rain screen 1 with a leading edge 2 which is displaced when deploying or retracting the screen 1, a trailing edge 4 which is inside a screen housing case 3 fixed for example on a cylindrical tube that can be rotated when deploying and retracting the screen, in a manner known in the art of covering systems.

The system further comprises two support poles 5, 6 to which the case 3 is fixed, two poles 9, 10 in the direction of which the screen 1 is deployed and two longitudinal flexible elements in the shape of wires 11, 12 attached at both ends to the poles 5, 6, 9 and 10, along which the screen 1 is deployed. In the embodiment of FIG. 1, the screen 1 is deployed over the wires 11, 12. At its leading edge 2, the screen 1 is attached to a transverse element in the shape of a rod 8 which is linked to the wires 11, 12 by roller cases 13, 14. The roller cases 13, 14 rest on the wires 11, 12 and ride back and forth when moving the screen 1 for deployment/retraction.

The roller cases 13, 14 can be clamped to wires 11, 12 at any point and then, once clamped, drawing back the screen 1 creates tension in the screen 1.

Figure 2:
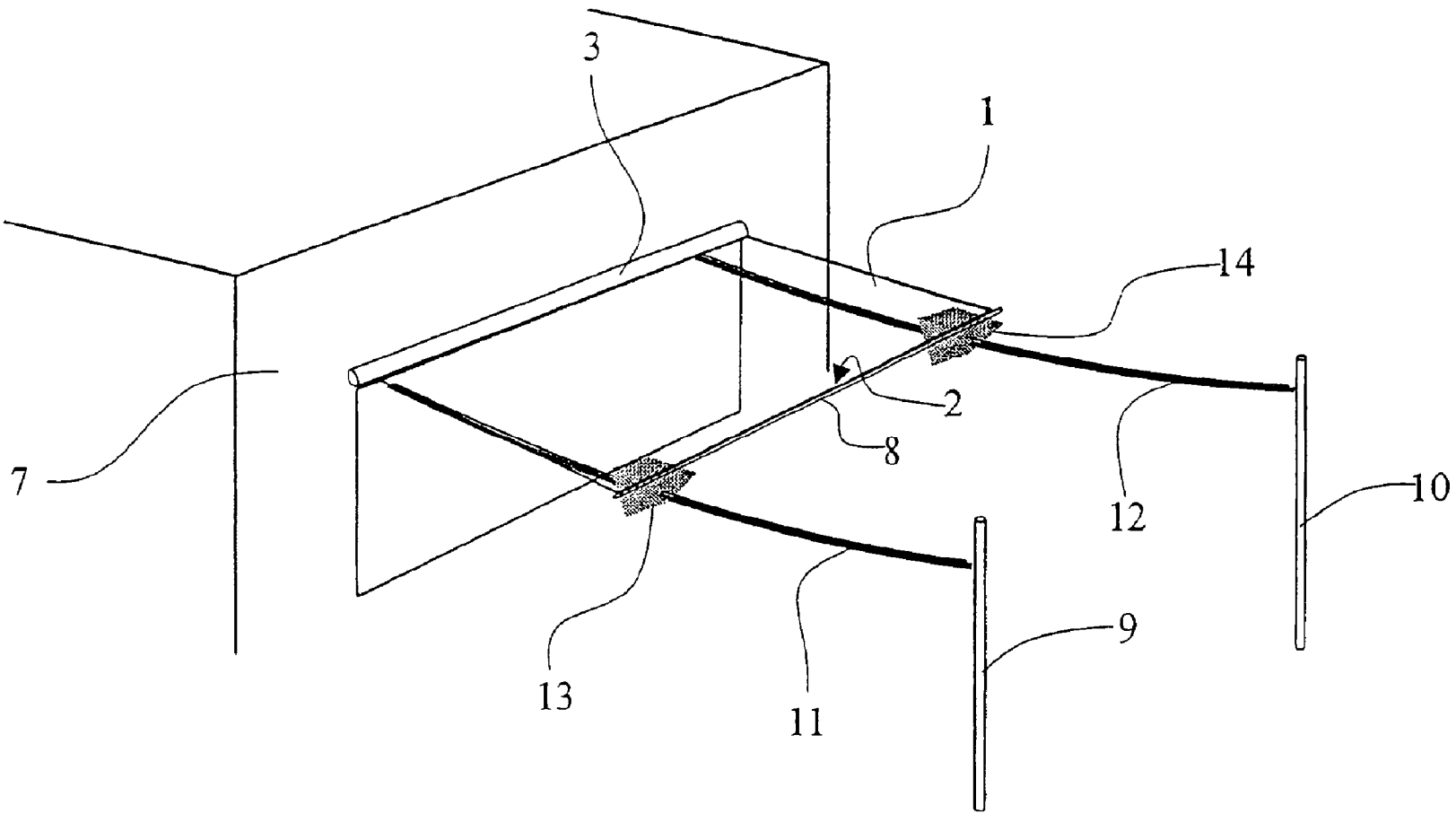
FIG. 2 shows a variant of the first embodiment of FIG. 1.

In FIG. 2, a variant of the embodiment of FIG. 1 is represented. In this variant, identical elements are referenced with the same numbers as in the first embodiment and reference is made to the above description. The difference between the embodiment of FIG. 1 and the variant of FIG. 2 resides in the replacement of the support poles 5, 6 by a wall 7. Accordingly, it is possible to mount the system of the invention on an existing structure, for example the wall of a house. It is also possible to mount the system of the invention to the roof of a house or to bridge a gap such as the open top of a stadium.

In this variant, the case 3 is attached to the wall 7 as are the wires 11, 12 and the screen 1 is deployed from the wall 7 in the direction of the poles 9, 10 by moving the roller cases 13, 14. Similarly, it can also be envisaged to replace the poles 9, 10 by an equivalent structure, for example a wall.

Figure 3:
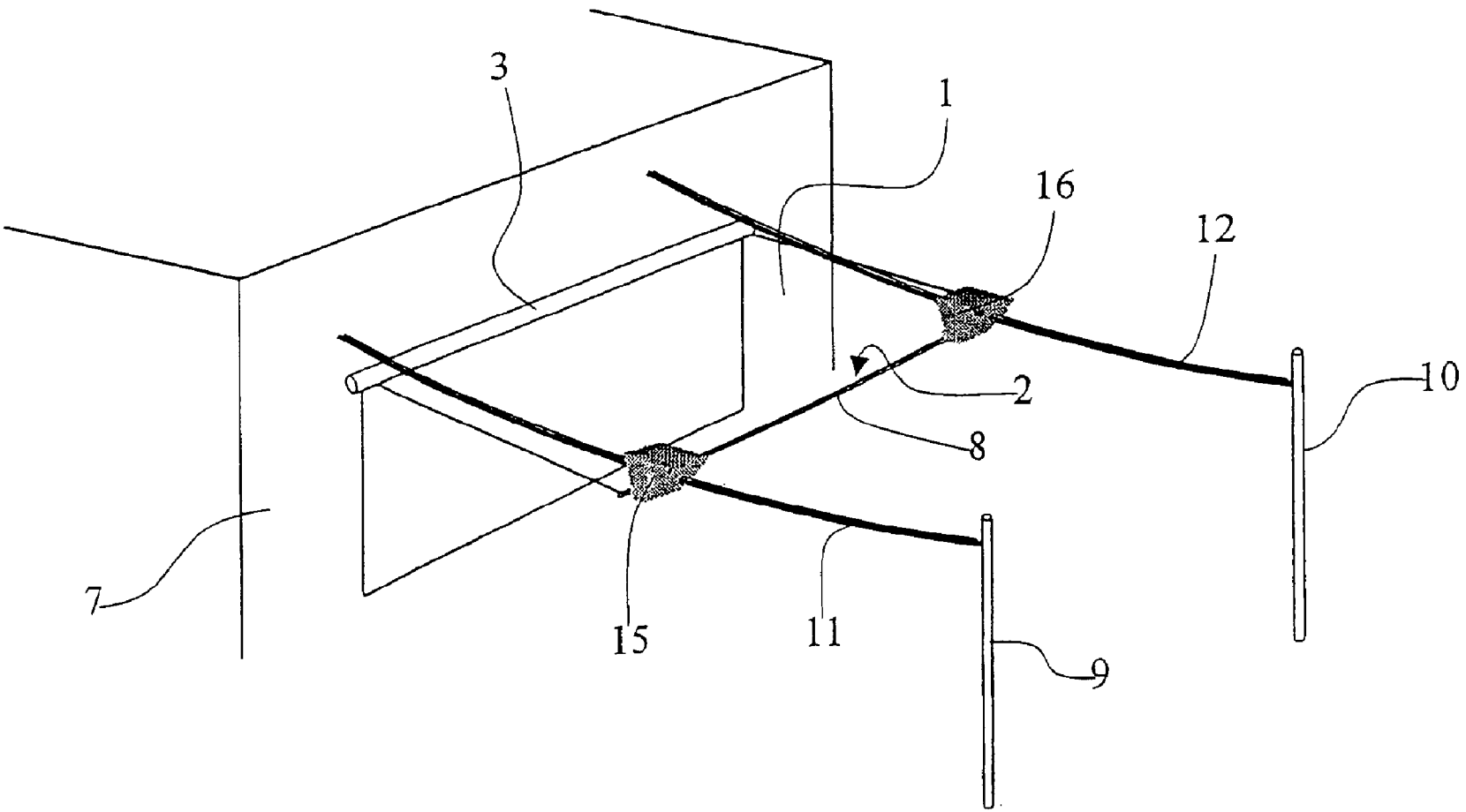
FIG. 3 shows another variant of the first embodiment of FIG. 1.

In the further variant represented in FIG. 3, the screen 1 is not deployed over the wires 11, 12 but is suspended underneath said wires 11, 12 as shown. All elements remain similar to the first embodiment, hence identical references, only the roller cases 15, 16 are different. Again, they are able to be clamped to the wires 11, 12 to allow the creation of tension in the screen 1 by drawing the screen 1 backwards once the roller cases are clamped.

Figure 5:
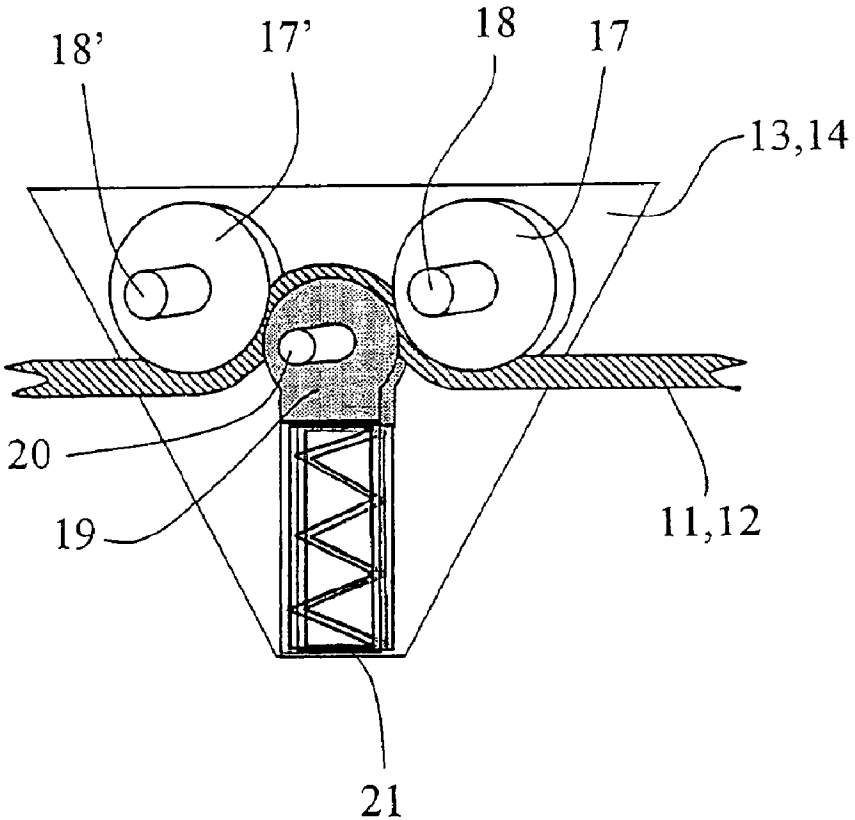
FIG. 5 shows the roller casing of FIG. 4 in a clamped state.
Figure 4:
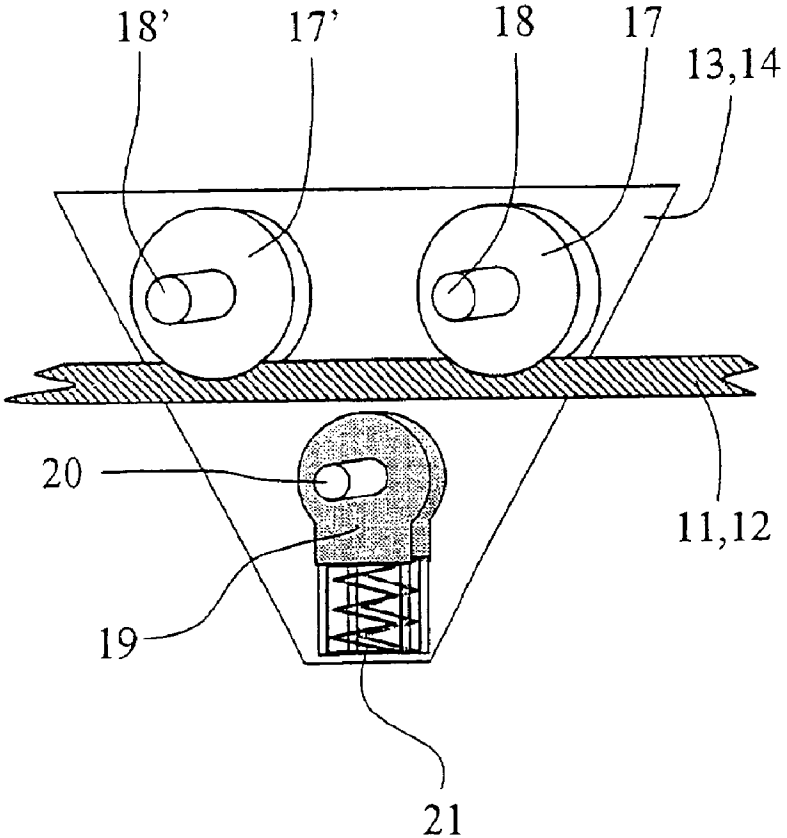
FIG. 4 shows an example of a roller casing for use with the embodiments of FIGS. 1 and 2.

An embodiment of a roller casing is represented in FIGS. 4 and 5, in FIG. 4 in a non-clamped state and in FIG. 5 in a clamped state, the following description being with reference to both FIGS. 4 and 5. The roller casing 14 (or 13 since they are identical) is attached to the screen 1 through rod 8, said rod being linked to the screen for example by folding over and stitching the end of the screen and running the rod through the pocket that is created. It comprises two rollers 17, 17' mounted on respective axes 18, 18' to allow their rotation when being moved back and forth on the wires 11, 12. Underneath the wire 12, 11, there is a clamping mechanism, for example made of a fixed clamping non-rotating wheel 19 mounted on and displaced by an axis 20, and pressed by a spring 21. By displacement of the axis 20 away from the wire, the non-rotating wheel 19 is displaced away from the wire 12, 11 and the roller case 14, 13 can be moved along the wire 12, 11. Once the screen is in position, the axis 20 is freed and the spring 21 pushes the non-rotating wheel 19 against the wire for clamping, as shown in FIG. 5. Preferably, a blocking system for the axis 20 is provided in order to maintain the system in an unclamped state which facilitates the movement of the roller casings along the wire 11, 12.

FIGS. 9A, 9C, 9E and 9G show four alternative roller cases 13, 14 in the unclamped state. FIGS. 9B, 9D, 9F and 9H show the clamped state of the respective roller cases 13, 14. Each of these roller cases 13, 14 has two upper rollers 17, 17' and a single lower roller 19', all being rotatable. If the roller cases 13, 14 are motorised, the lower roller 19' provides enough pressure from below that the wire 11, 12 is gripped between the upper and lower rollers 17, 17', 19' and when the rollers rotate, the roller cases 13, 14 and the screen 1 attached to the roller cases are pulled along the wire 11, 12. Once the screen 1 is deployed to the desired position and the roller cases 13, 14 are to be locked, the pressure from the lower roller 19' is increased to an extent whereby the upper and lower rollers 17, 17', 19' cannot move over the wire 11, 12, thereby clamping the screen 1 in position.

Figure 9A:
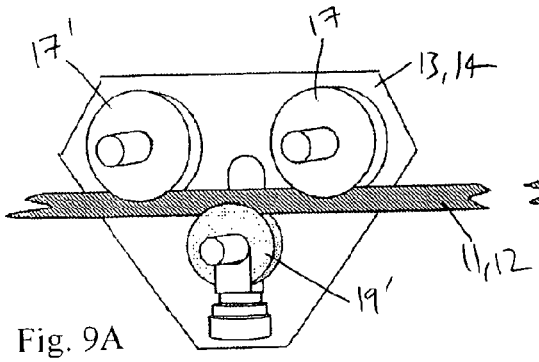
FIGS. 9A to 9H show four alternative roller casings in the unclamped state and in the clamped sate.
Figure 9B:
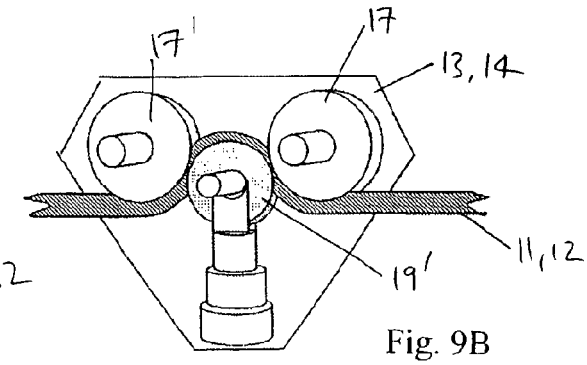
Figure 9C:
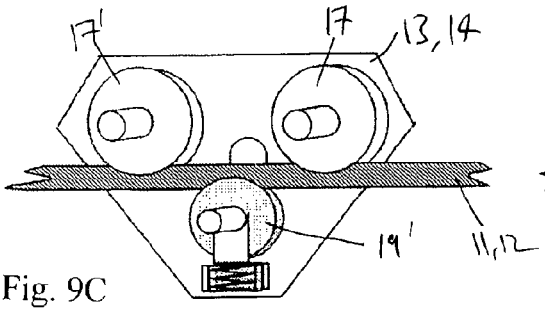
Figure 9D:
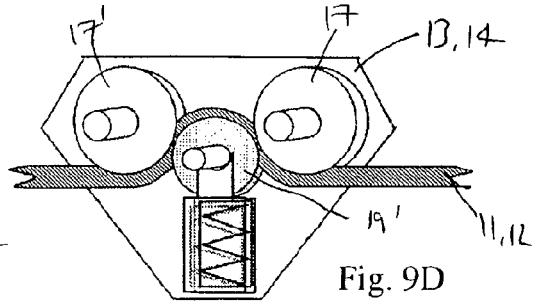
Figure 9E:
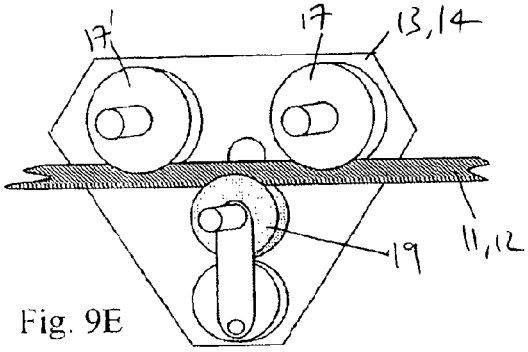
Figure 9F:
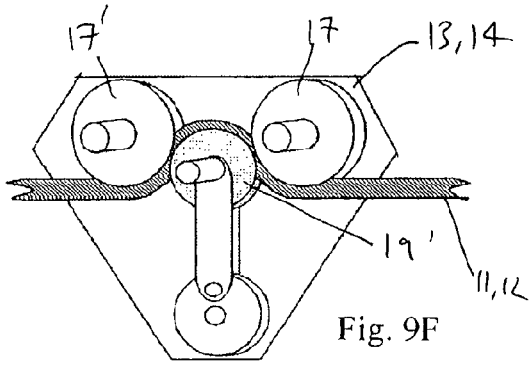
Figure 9G:
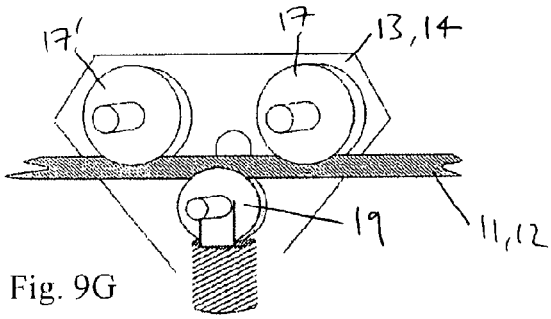
Figure 9H:
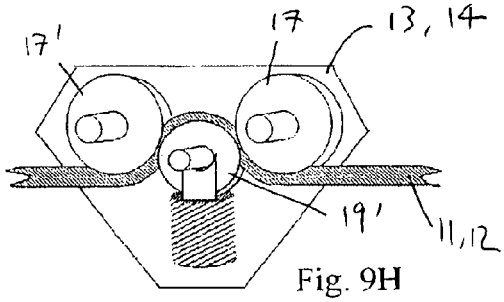

FIGS. 9A and 9B show an embodiment in which the lower roller 19' is actuated pneumatically or hydraulically. FIGS. 9C and 9D show an embodiment in which the lower roller 19' is actuated by a spring. FIGS. 9E and 9F show an embodiment in which the lower roller 19' is actuated by a camming device. FIGS. 9G and 9H show an embodiment in which the lower roller is actuated by a screw.

Figure 10C:
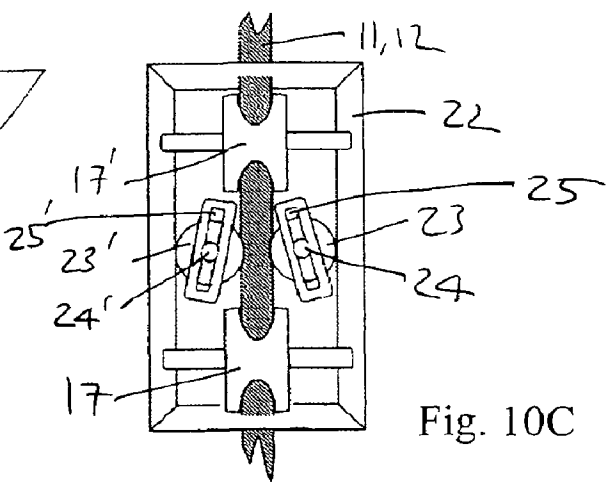
FIGS. 10A to 10C show an end view, a side view and a top view of another alternative roller casing in the unclamped state.
Figure 10B:
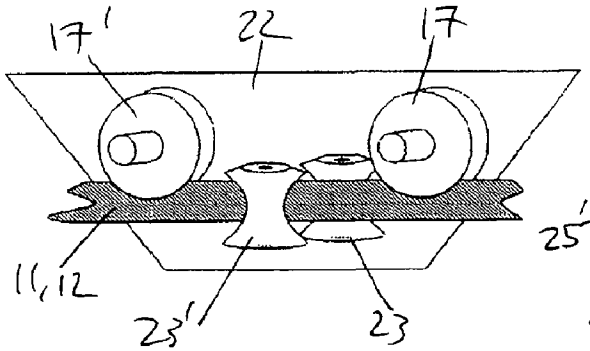
Figure 10A:
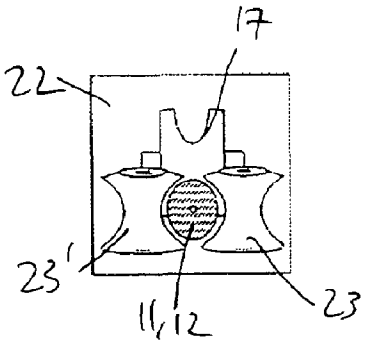
Figure 11C:
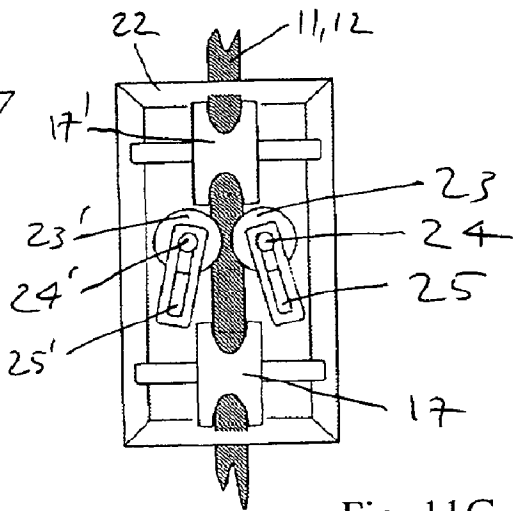
FIGS. 11A to 11C show the roller casing of FIGS. 10A to 10C in the clamped state.
Figure 11B:
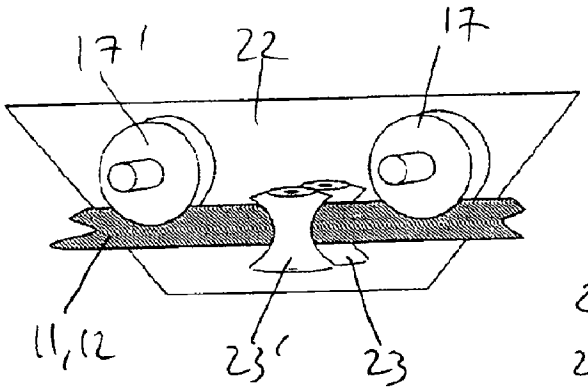
Figure 11A:
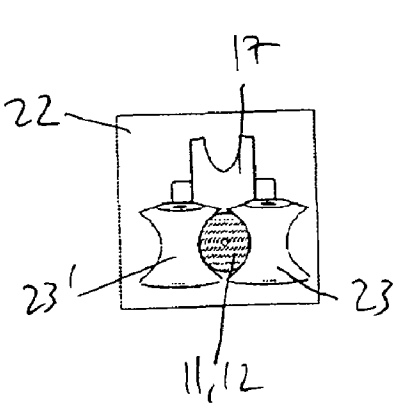

FIGS. 10A, 10B and 10C respectively show an end view, a side view and a top view of another alternative roller case 22 in the unclamped state. FIGS. 11A, 11B and 11C show the corresponding clamped state.

The roller case of FIGS. 10 and 11 has two upper rollers 17, 17' and two side rollers 23, 23', the side rollers 23, 23' being capable of clamping the wire 11, 12. As can be seen in the top views of FIGS. 10C and 11C, the side rollers 23, 23' rotate around substantially vertical axles 24, 24'. These axles 24, 24' are each slidably mounted in slots 25, 25' so that the axles 24, 24' can slide back and forth within the roller case 22. The slots 25, 25' are arranged on opposite sides of the wire 11, 12 so that they are closer together at the end nearest the leading edge 2 of the screen 1 than they are at the end furthest from the leading edge 2 of the screen 1.

With this arrangement, when the roller case 22 and screen 1 are pulled out in a direction of extending the screen 1, the axles 24, 24' of the side rollers 23, 23' are dragged back in the direction of the trailing edge 4 of the screen 1. Therefore the side rollers 23, 23' move further apart and do not clamp the wire 11, 12. However, if the roller case 22 and screen 1 are pulled in the direction of retracting the screen 1, the axles 24, 24' of the side rollers 23, 23' are dragged forward in the direction of the leading edge 2 of the screen 1. Therefore the side rollers 23, 23' move closer together and clamp the wire 11, 12, preventing further retraction.

A release mechanism (not shown) can be provided for holding the side rollers 23, 23' apart so that the screen 1 can be retracted easily.

Of course other equivalent systems may be used for clamping the roller case to the wires and this is only given as a non-limiting example.

Figure 6:
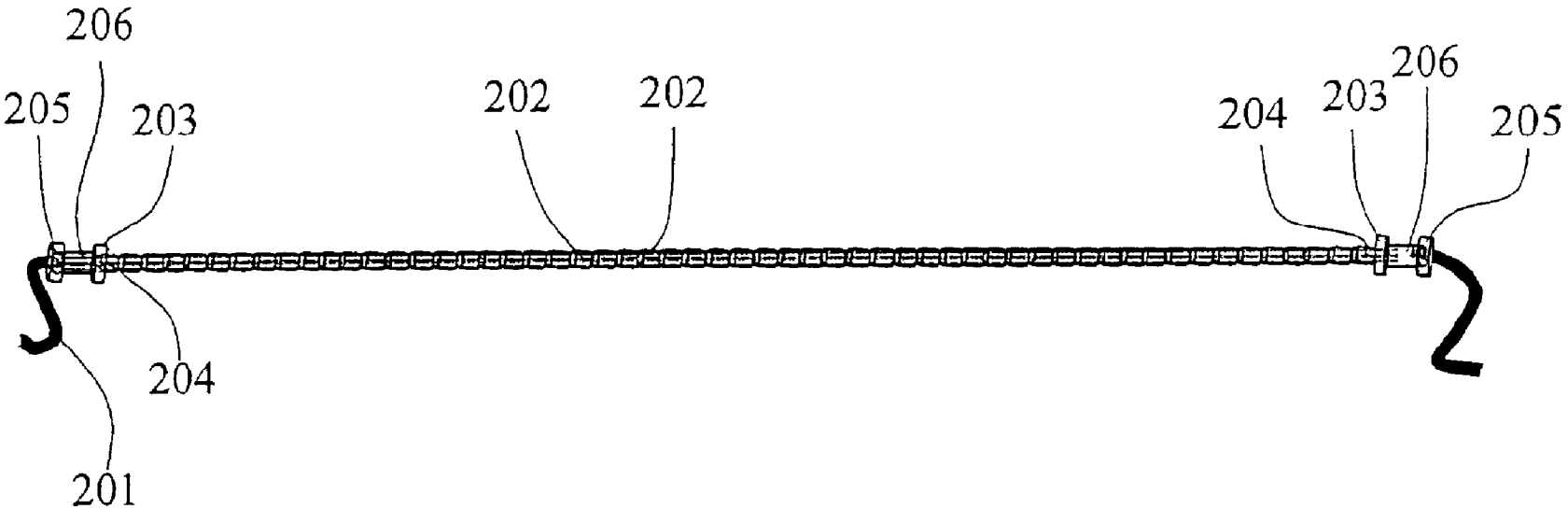
FIG. 6 shows an embodiment of a transversal element.

In order to avoid sag of the rod 8, over a wide span, it is possible to use a wire thread through a series of tubes clamped at both ends and stretched. An example of such system is shown in FIG. 6. A wire 201 is provided over which a number of solid tubes 202 are placed to cover the necessary span of the covering system. At each end of the wire 201, there is a first clamp 203 attached to end tubes 204 and a second clamp 205 attached to the wire 201. Between clamps 205 and 203, there is a centre piece 206 used to increase tension in the wire 201 by pushing clamps 205, 206 away from each other. The centre piece 206 has a screw head at both ends. Accordingly, turning the centre piece in one direction allows the clamps to be pushed apart hence building tension in the wire, whereas turning the piece 206 in the opposite direction will decrease the tension by moving the clamps closer to each other. Another means of providing tension in this case could be by ratchet. In this embodiment, the screen can be attached to the tubes 202 by folding over and stitching the end of the screen and running the wired tubes through the pocket that is created.

Figure 7A:
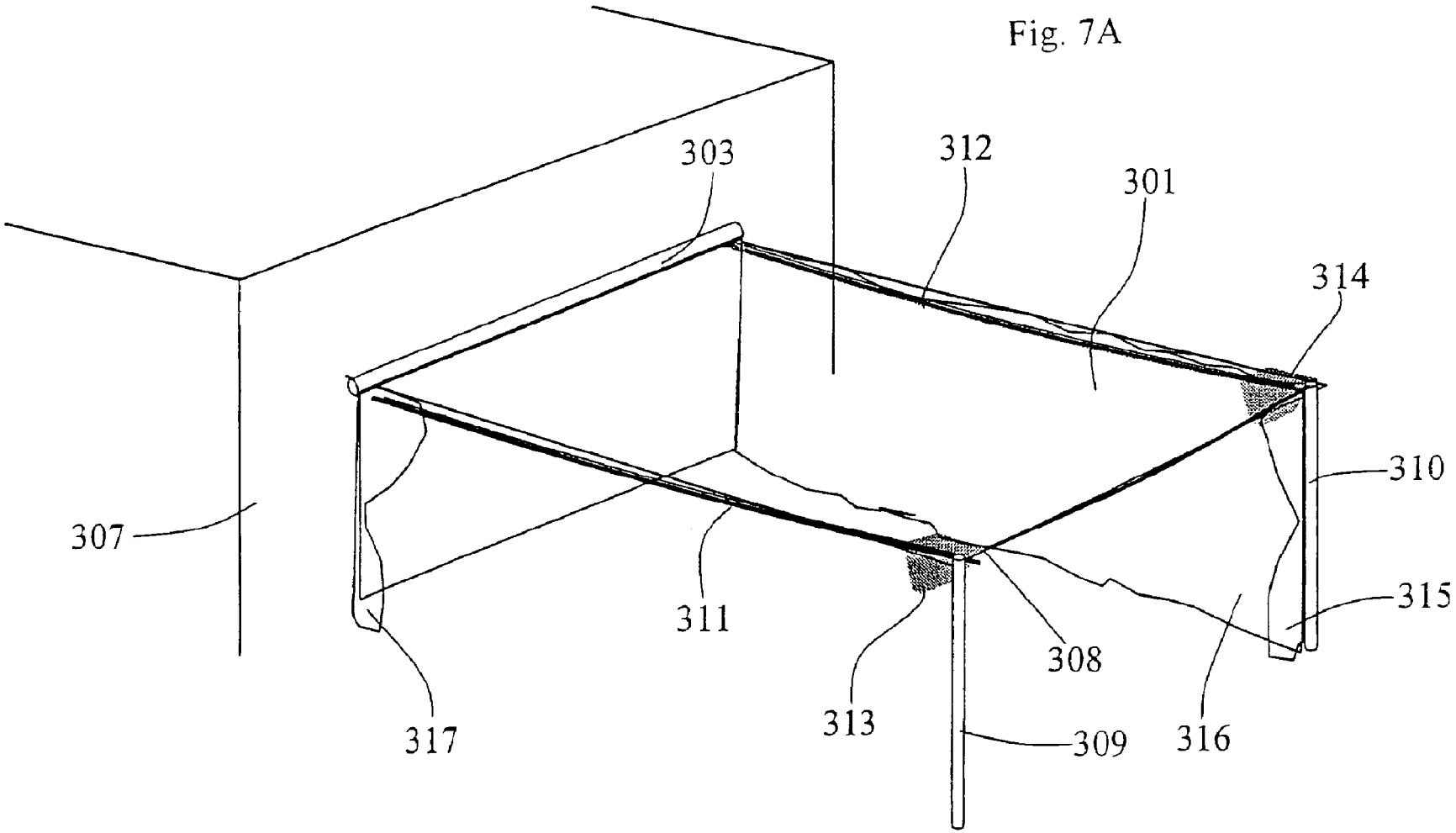
FIGS. 7A and 7B show another embodiment of the covering system according to the invention.
Figure 7B:
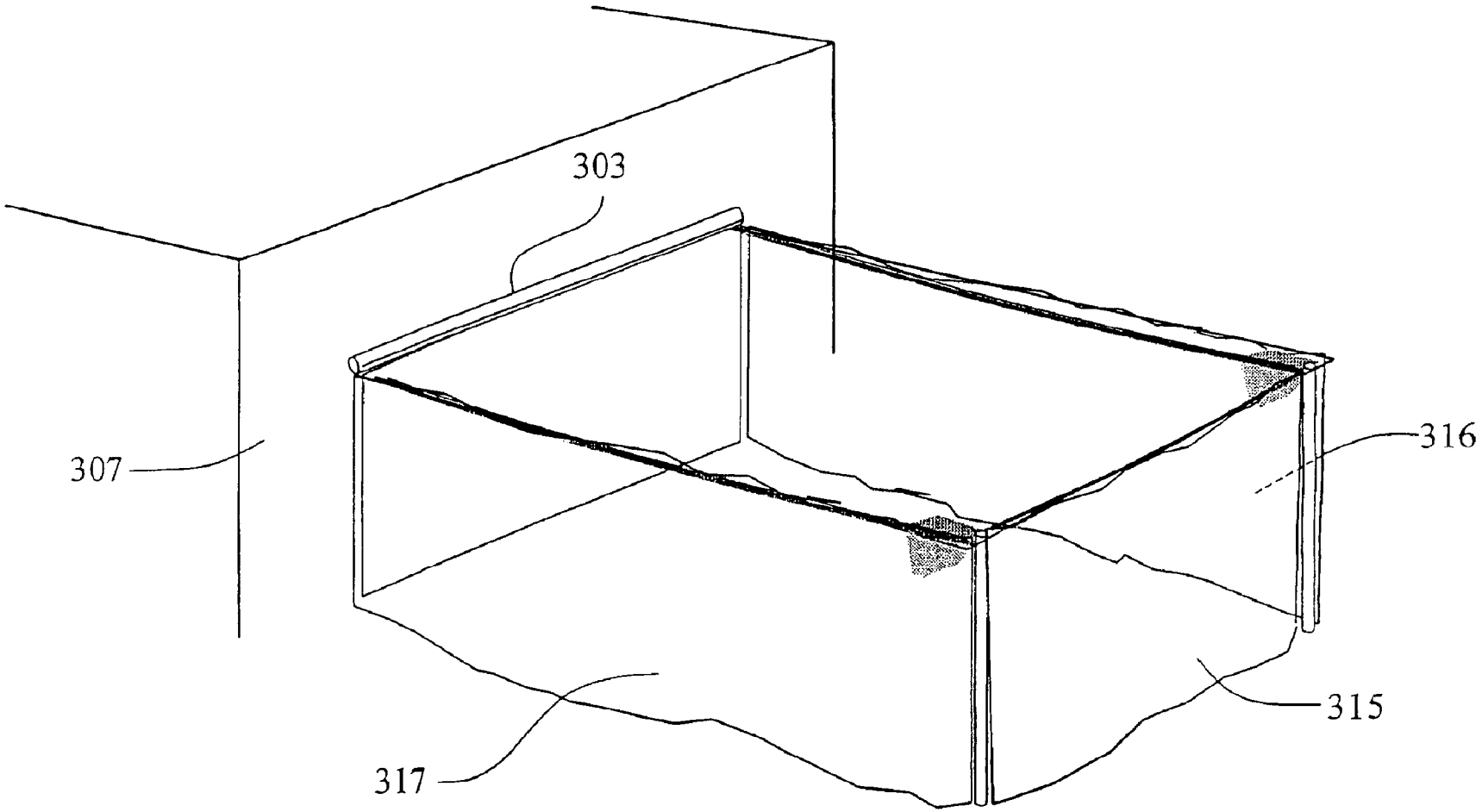

In FIGS. 7A and 7B, a further embodiment of the covering system is shown. This embodiment, which has the same working principle as the other embodiments described above, has a screen 301 attached to a casing 303 mounted on a wall 307. The screen 301 is deployed over wires 311, 312 through roller casings 313, 314. The wires are fixed to wall 307 and poles 309, 310, as described above in relation to the other embodiments. By drawing curtains 316, 317 along the wires on both sides and drawing another curtain 315 between the two supporting poles 309, 310, fixed by conventional means, the system can also be converted into a closed "tent like" fixture (see FIG. 7B).

Figure 8:
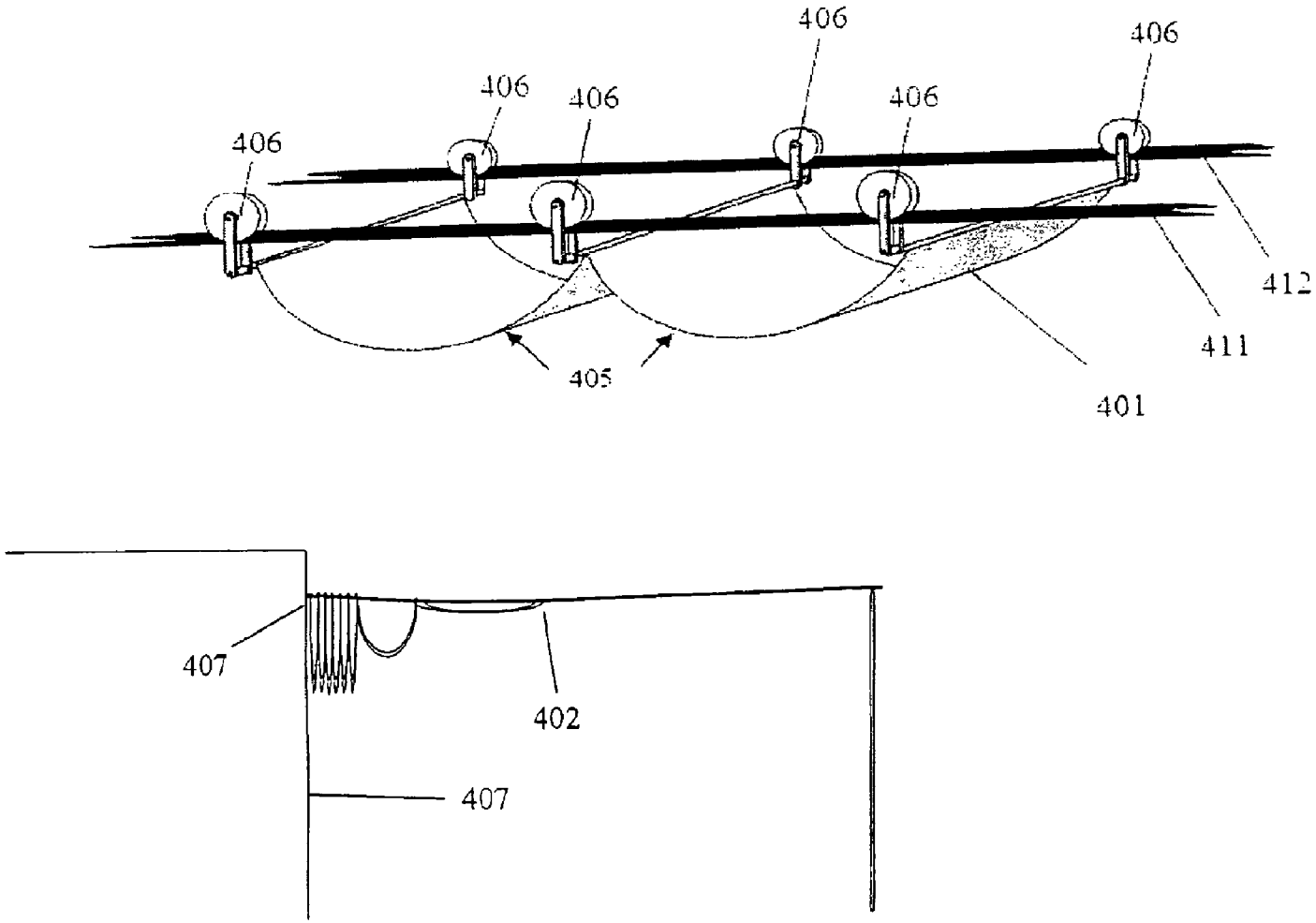
FIG. 8 shows a further embodiment of the covering system.

In FIG. 8, a further embodiment of the invention is schematically shown to represent the principle of this embodiment. In this embodiment, which uses the principle of the invention, instead of a screen housing case from which the screen 401 is unrolled or in which the screen is rolled, one uses a screen 401 that is folded in segments and each segment is unfolded when deploying the screen 401. One end (the trailing edge 404) of the screen 401 is fixed to an initial structure, for example a wall 407, and the leading edge 402 can be pulled along the wires 411, 412 until the desired position is attained, each segment 405 being deployed on separate rollers 406. The leading edge is fixed to a transversal element and to roller casings that can be clamped with respect to the wires as described above in relation to previous embodiments and not specifically represented in FIG. 8. To allow tension in the screen, the rollers are held back by appropriate holding means against the initial structure 407 and released one by one.

The drawings illustrate schematic views of the poles and of how they would remain erect. In practice, it can be envisaged to use additional means of support, such as a steel wire stretched from the top of each pole and anchored diagonally to the ground.

The system of the invention can be used for many applications, for example for covering a part of a garden large or small, a swimming pool or a tennis court. The system has many advantages, such as simplicity, lightness, and being able to span large areas. Furthermore, if steel wires are used as the longitudinal flexible elements they can withstand a heavy weight (thousands of kg) and the cover can be quickly and easily drawn and retracted.

The entire apparatus can be easily assembled, dismantled and stored away when not in use, in contrast with prior art metal frames that remain erect when not in use due to the time and work involved in dismantling them.

As is known in the art of such protection and cover systems and the art of electric motorization, the screen rolls and curtains can be activated electrically as well as manually and, as is known in the art of electric motorisation, the rollers and clamps and wheels can also be activated electrically as well as manually.

Figure 24:
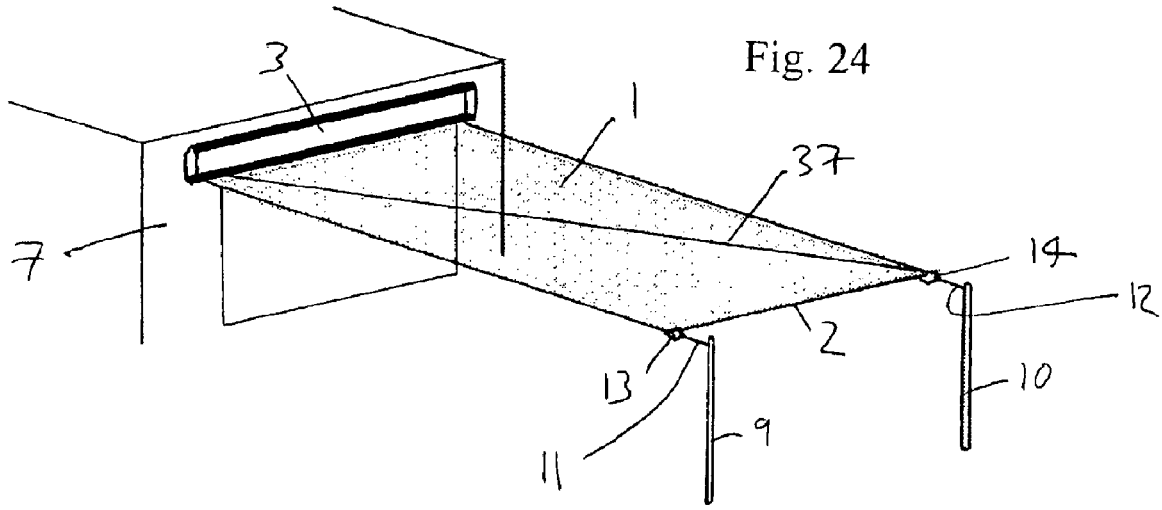
FIGS. 24 and 25 show alternative power cable arrangements for transferring electric power along the screen of a covering system according to the invention.
Figure 25:
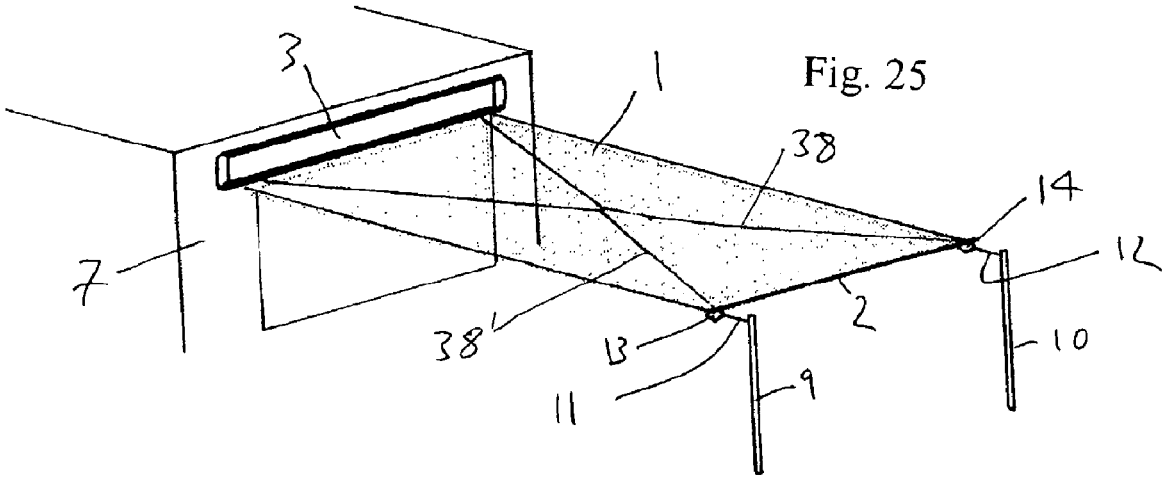

FIGS. 24 and 25 show an embodiment of the invention in which the screen 1 can be extended or retracted electrically. The rollers 17, 17' in the roller cases 13, 14 are electrically powered so as to extend or retract the screen 1. The clamping mechanism can also be electrically actuated.

In order to operate the motors in the roller cases 13, 14, electrical power must be transferred from an external power supply. In FIG. 24 an electrical wire 37 runs diagonally from one corner at the trailing edge 4 of the screen 1 to the diagonally opposite corner at the leading edge 2 of the screen 1. When the screen 1 is rolled up, the wire 37 is distributed evenly across the width of the screen roll and the diameter of the roll is uniform and minimised. In this way, power can be transmitted from an external power supply, through the wire 37 to the roller case 13. Power can then be transferred to the other roller case 14 by running another wire (not shown) along the transverse rod 8 at the leading portion 2 of the screen 1.

In FIG. 25, two electrical wires 38, 38' run diagonally to the centre of the screen 1, one from each corner at the trailing edge 4 of the screen 1. Each wire 38, 38' changes direction at the centre of the screen 1 and they run diagonally to the corners at the leading edge of the screen 1. The wires 38, 38' are held together at the centre so as to maintain the X-shape formed by the wires 38, 38'.

At the trailing edge 4 of the screen 1 the wires 37, 38, 38' are connected to an external power supply (not shown).

The wires 37, 38, 38', whether carrying electricity or not, also serve to reinforce the material of larger screens. For the purpose of reinforcement, straps may be used instead of wires.

Figure 12:
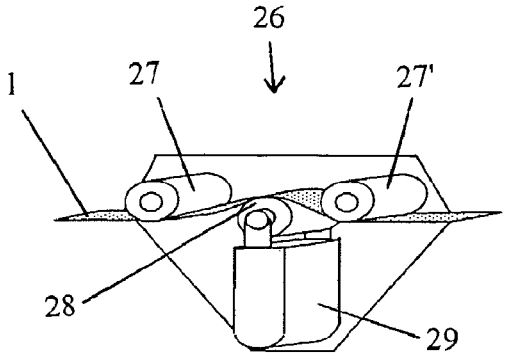
FIG. 12 shows an embodiment of a tension sensor according to the invention when the screen is in a state of low tension.
Figure 13:
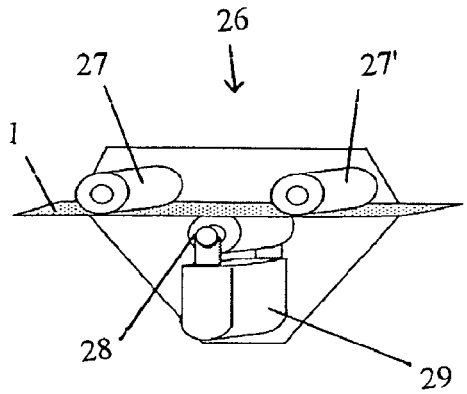
FIG. 13 shows the tension sensor of FIG. 12 when the screen is in a state of high tension.

FIGS. 12 and 13 show a tension sensor 26 for an automatic retraction system according to the invention. FIG. 12 shows the tension sensor 26 when the screen 1 is in a state of low tension and FIG. 13 shows the tension sensor 26 when the screen 1 is in a state of high tension. The tension sensor 26 shown in FIGS. 12 and 13 has two upper rollers 27, 27' located above the screen 1 and a single lower roller 28 located below the screen 1. The lower roller 28 is mounted on a pressure sensor 29 so that when the screen 1 is under no tension or under low tension, the lower roller 28 biases the screen 1 upwardly between the two upper rollers 27, 27'. When tension in the screen 1 increases, the lower roller 28 is biased downwardly and pressure sensor 29 senses a greater pressure. If the pressure sensor 29 senses a pressure greater than a predetermined threshold value, a warning may be generated, or if the screen is motorised, the screen may be automatically retracted.

Figure 14:
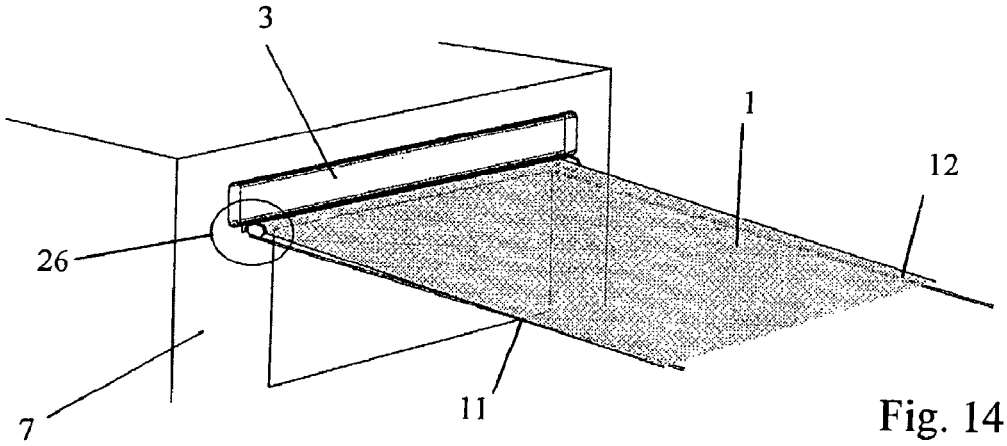
FIG. 14 shows an embodiment of a covering system of the invention including a tension sensor as shown in FIGS. 12 and 13.
Figure 15:
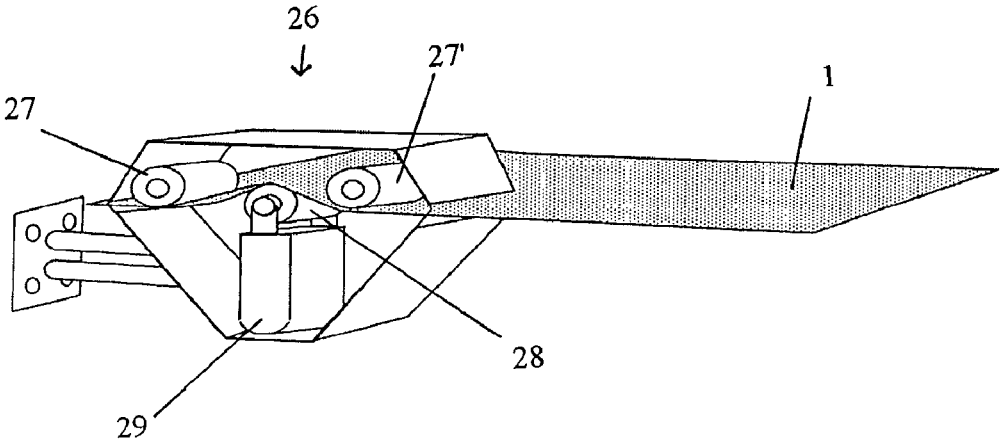
FIG. 15 is an enlarged view of FIG. 14.

FIG. 14 shows the tension sensor 26 of FIGS. 12 and 13 mounted on a wall 7 which forms the first support of a covering apparatus according to the invention. FIG. 15 is an enlarged view of FIG. 14.

Figure 16:
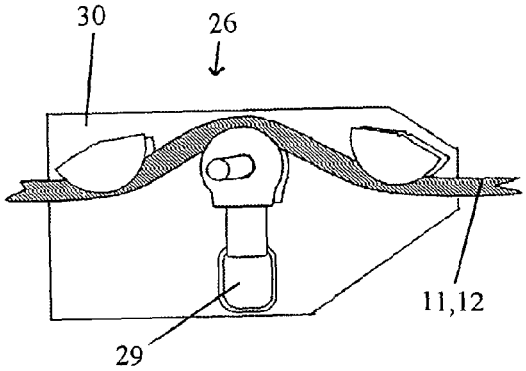
FIG. 16 shows another embodiment of a tension sensor according to the invention when the cable is in a state of low tension.
Figure 17:
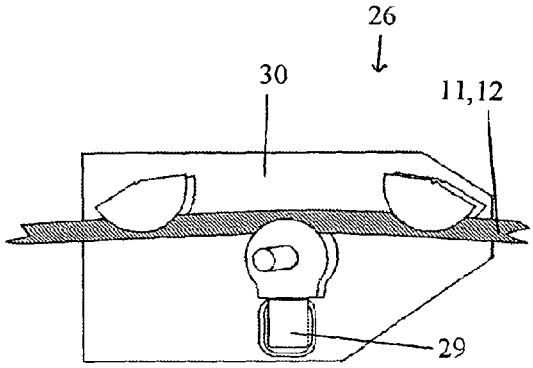
FIG. 17 shows the tension sensor of FIG. 16 when the cable is in a state of high tension.

FIGS. 16 and 17 show another embodiment of a tension sensor 26 according to the invention. In this embodiment, the tension sensor 26 senses the tension in a wire 11, 12 of the covering system rather than sensing the tension in the screen 1. (as in FIGS. 12 and 13). The tension in the screen 1 is directly transmitted to the wires 11, 12. Each time the screen 1 is deployed or retracted, the pressure sensor 29 is calibrated. If the pressure sensor 29 senses a pressure greater than a predetermined threshold, it issues a warning or, if the screen 1 is motorised, causes the screen 1 to be retracted. In this embodiment, the tension sensor 26 can easily be combined with the roller case 13, 14, 15, 16, 22 and clamping arrangement of the covering system described above.

Figure 18:
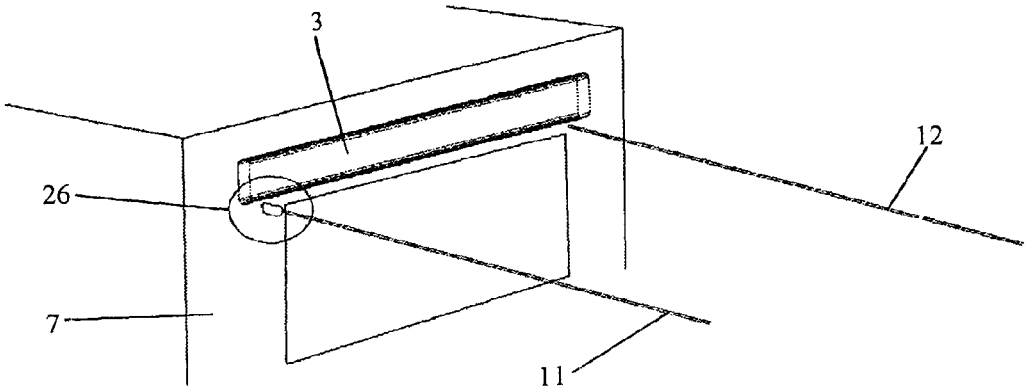
FIG. 18 shows an embodiment of a covering system of the invention with a tension sensor as shown in FIGS. 16 and 17.
Figure 19:
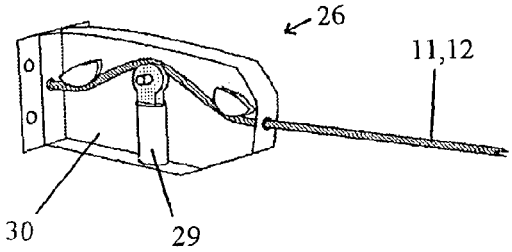
FIG. 19 shows an enlarged view of FIG. 18.

FIG. 18 shows the tension sensor 26 of FIGS. 16 and 17 mounted on a wall 7 which forms the first support of a covering apparatus according to the invention. FIG. 19 is an enlarged view of FIG. 18.

It will be appreciated that FIGS. 12 to 19 show the bend in the wire 11, 12 or screen 1 slightly exaggerated. A digital pressure sensor would be used that does not require such a bend in the wire 11, 12.

The tension sensors 26 shown in FIGS. 12 to 19 are enclosed within a housing 30 and therefore are protected from the weather. These systems are therefore more reliable than those involving wind sensors which must necessarily be exposed to the elements.

Figure 20:
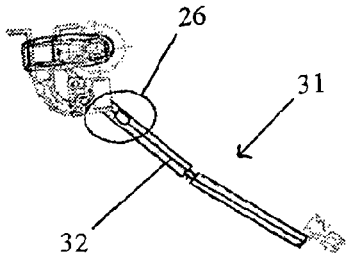
FIG. 20 shows an alternative covering system employing a tension sensor according to the invention.

FIG. 20 shows an alternative covering system employing a tension sensor 26 according to the invention. The alternative covering system shown in FIG. 20 is of the type which uses a folding arm 31 with a cable 32 running through it. The tension sensor 26 is located inside the arm 31 and detects the tension in the cable 32 which is directly related to the tension in the covering sheet 1.

Figure 21:
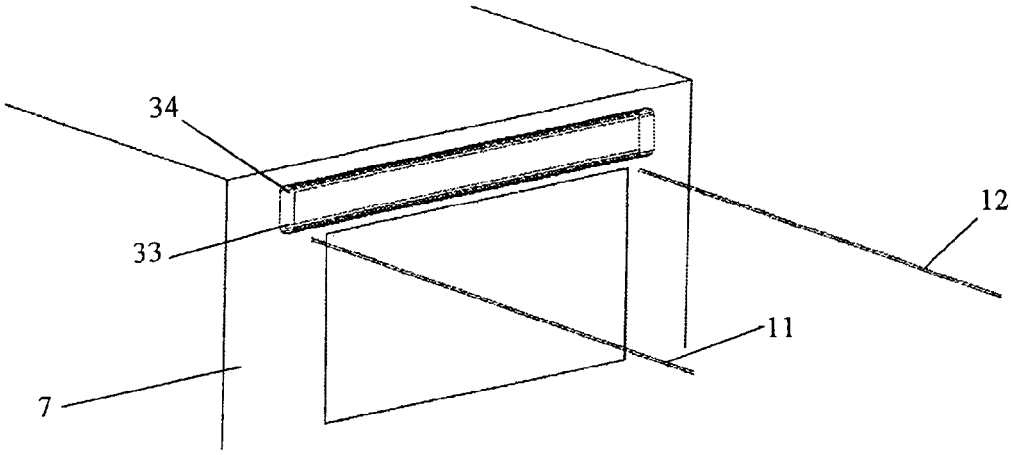
FIG. 21 shows an embodiment of a storage system according to the invention.

FIG. 21 shows a storage system for a flexible sheet 1. The storage system has two rollers 33, 34 which are synchronously driven so that the sheet 1 is stored around the rollers 33, 34 with a cross-sectional shape determined by the arrangement of the rollers 33, 34 (i.e. substantially oval in this embodiment). By storing the flexible sheet 1 around more than one roller, space can be used more efficiently. For example in FIG. 21, the sheet 1 is kept more flat against the wall 7 than would be possible if it was all stored on a single roller.

Figure 22:
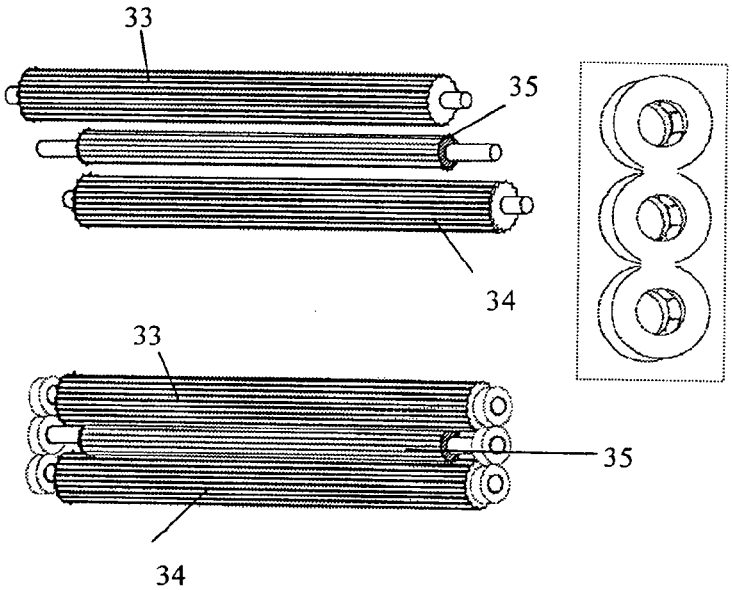
FIGS. 22 and 23 show alternative ways of operating the storage system of FIG. 21.
Figure 23:
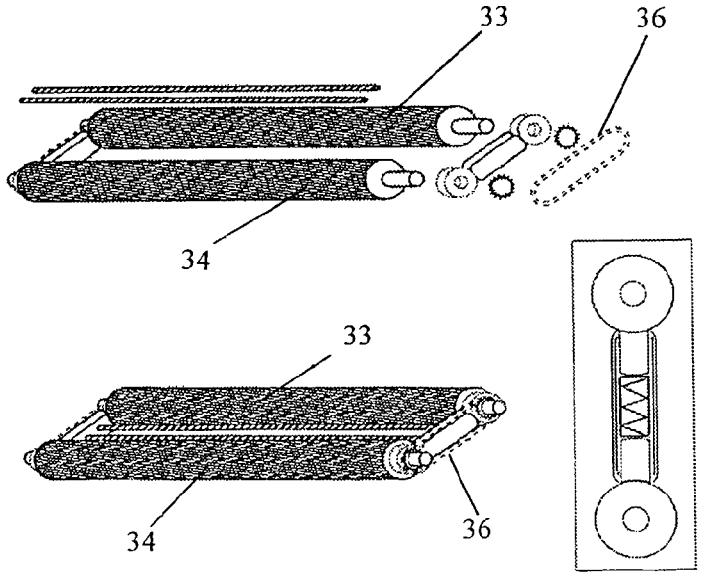

FIGS. 22 and 23 show two ways in which the storage system of FIG. 21 can be driven. In FIG. 22 the two storage rollers 33, 34 are driven by a third drive roller 35 of smaller diameter than the storage rollers 33, 34 and located between the storage rollers 33, 34 in driving contact therewith. In this way, both storage rollers 33, 34, which have the same diameter, are driven in the same direction at the same speed. In FIG. 23 the two storage rollers 33, 34 are connected by a chain 36 so that when one roller 33, 34 is driven, the other roller 34, 33 is also driven synchronously.

It should be apparent that the foregoing relates only to the preferred embodiments of the present application and that numerous changes and modification may be made herein by one of ordinary skill in the art without departing from the general spirit and scope of the invention as defined by the following claims and the equivalents thereof.

I claim:

1. A covering apparatus for covering an outdoor area comprising a screen that can be operated between a retracted and an extended configuration, the screen having a leading portion and a trailing portion, the trailing portion being connected to a first support, the apparatus further comprising a plurality of longitudinal flexible elements extending from the first support to a respective second support, and the leading portion of the screen being supported by the longitudinal flexible elements as the screen is operated from the retracted to the extended configuration, wherein the leading portion of the screen is moveably mounted to the longitudinal flexible elements such that the leading portion moves with respect to the longitudinal flexible elements during operation between retracted and extended positions, and wherein at least one clamping system is provided on the leading portion of the screen for releasably clamping the leading portion to at least one of the longitudinal flexible elements.

2. A covering apparatus as claimed in claim 1, wherein the leading portion is supported by the longitudinal flexible elements when the screen is deployed in at least a partially extended configuration.

3. An apparatus as claimed in claim 1, further comprising a transverse element fixed to the leading portion of the screen.

4. An apparatus as claimed in claim 3, further comprising a roller casing disposed on each longitudinal flexible element, each roller casing comprising at least two rollers which allow the roller casing to slide along the respective longitudinal flexible element.

5. An apparatus as claimed in claim 4, wherein the leading portion of the screen is attached to the roller casings via the transverse element, to moveably mount the leading portion of the screen to the longitudinal flexible elements.

6. An apparatus as claimed in claim 4, wherein said roller casing further comprises said clamping system to clamp the roller casing to the respective longitudinal flexible element when the roller casing is placed in a desired position.

7. An apparatus as claimed in claim 6, wherein said clamping system comprises a plate which is pushed into a clamping position by a spring.

8. An apparatus as claimed in claim 6, wherein said clamping system comprises a clamping roller which is biased into a clamping position by a spring, a screw, a camming device, a pneumatic arrangement or a hydraulic arrangement.

9. An apparatus as claimed in claim 6, wherein said clamping system comprises two side rollers arranged on opposite sides of the longitudinal flexible element, the side rollers being biased into a clamping position when the screen is pulled in the retracting direction and into a non-clamping position when the screen is pulled in the extension direction.

10. An apparatus as claimed in claim 9, wherein the side rollers are rotatably mounted on side roller axles which are slidably mounted in slots, wherein said slots are closer together at the end nearest the leading edge of the screen than they are at the end furthest from the leading edge of the screen.

11. An apparatus as claimed in claim 3, wherein said transverse element is a rod.

12. An apparatus as claimed in claim 3, wherein said transverse element is a wire thread covered by a series of solid tubes clamped at both ends of the wire by clamps and under tension.

13. An apparatus as claimed in claim 3, further comprising a roller casing disposed on each longitudinal flexible element, each roller casing comprising at least one roller which allows the roller casing to slide along the respective longitudinal flexible elements.

14. An apparatus as claimed in claim 1, wherein the longitudinal flexible elements are wires under tension.

15. An apparatus as claimed in claim 1, wherein said first support comprises a plurality of poles or a wall or a roof.

16. An apparatus as claimed in claim 1, wherein said second support comprises a plurality of poles or a wall or a roof.

17. An apparatus as claimed in claim 1, further comprising at least one curtain attached laterally on the longitudinal flexible elements.

18. An apparatus as claimed in claim 1, comprising at least one curtain attached between a plurality of the second supports.

19. An apparatus as claimed in claim 1, comprising at least one curtain attached between a plurality of the first supports.

20. An apparatus as claimed in claim 1, wherein the trailing portion is attached to the first support via a screen case from which the screen is unrolled when being deployed or into which the screen is rolled when being retracted.

21. An apparatus as claimed in claim 1, further comprising an automatic retraction system.

22. An apparatus as claimed in claim 21, wherein the automatic retraction system comprises a tension sensor which senses the tension in the screen and causes the automatic retraction system to retract the screen when a threshold tension is exceeded.

23. An apparatus as claimed in claim 21, wherein the automatic retraction system comprises a tension sensor which senses the tension in at least one of the longitudinal flexible elements and causes the automatic retraction system to retract the screen when a threshold tension is exceeded.

24. An apparatus as claimed in claim 23, wherein the tension sensor is calibrated each time the screen is deployed or retracted.

25. An apparatus as claimed in claim 23, wherein the tension sensor is located in the roller case.

26. An apparatus as claimed in claim 25, wherein the tension sensor forms an integral part of the clamping system.

27. An apparatus as claimed in claim 26, wherein the apparatus comprises two storage rollers, and wherein the frictional engagement is provided by a spring which biases the two storage rollers apart.

28. An apparatus as claimed in claim 1, wherein the apparatus comprises a plurality of storage rollers around which the screen is wrapped when retracted.

29. An apparatus as claimed in claim 28, wherein the trailing edge of the screen is passed around the plurality of rollers and attached back to the screen so as to form a loop around the plurality of rollers and in frictional engagement therewith, the friction between the screen and the plurality of rollers being such that when at least one of the rollers is driven so as to retract the screen, the screen is wound around the plurality of rollers.

30. An apparatus as claimed in claim 28, wherein the screen is attached to a frictional base member, the frictional base member being provided around the plurality of rollers in frictional engagement therewith, and the friction between the base member and the plurality of rollers being such that when at least one of the rollers is driven so as to retract the screen, the screen is wound around the plurality of rollers.

31. An apparatus as claimed in claim 1, wherein the apparatus comprises at least one power transferring cable for transferring power diagonally along the screen from the trailing portion of the screen to the leading portion of the screen.

* * * * *